United States Patent [19]

Edgar et al.

[11] 4,059,465

[45] Nov. 22, 1977

[54] METHOD OF FORMING CARPET TILES

[76] Inventors: John B. Edgar, 9 Eastwood Ave., Giffnock, Glasgow; Peter W. Bell, 66 Lomond Crescent, Beith, both of Scotland

[21] Appl. No.: 322,158

[22] Filed: Jan. 9, 1973

[51] Int. Cl.[2] ..... B32B 5/02

[52] U.S. Cl. ..... 156/72; 156/231; 156/246; 156/258; 156/267; 428/85

[58] Field of Search ..... 156/72, 78, 79, 230, 156/231, 238, 246–248, 279, 267, 282, 297, 299, 508, 509, 540–542, 522, 551, 552, 435, 258; 161/67, 89, 151; 112/410; 83/925 R; 52/384, 385; 428/62, 82, 85

[56] References Cited

U.S. PATENT DOCUMENTS

| | | | |
|---|---|---|---|
| 2,675,337 | 4/1954 | Walker et al. | 156/72 |
| 2,784,630 | 3/1957 | Koprow et al. | 156/72 |
| 3,014,829 | 12/1961 | Curtin | 156/72 |
| 3,142,611 | 7/1964 | Mills | 156/72 |
| 3,309,252 | 3/1967 | Adler | 156/435 |
| 3,473,495 | 10/1969 | Nusbaum | 112/410 |
| 3,479,241 | 11/1969 | Partensky | 156/72 |
| 3,583,889 | 6/1971 | Califano et al. | 156/248 |
| 3,621,743 | 11/1971 | Feighery et al. | 83/925 R |
| 3,701,700 | 10/1972 | Von Der Heide | 156/435 |
| 3,728,182 | 4/1973 | Wisotzky et al. | 156/72 |

*Primary Examiner*—Charles E. Van Horn
*Assistant Examiner*—John E. Kittle
*Attorney, Agent, or Firm*—Young & Thompson

[57] ABSTRACT

To form carpet tiles that lie flat, a layer of thermoplastic material is doctored onto a carrier sheet and a piece of carpeting to be coated is laid on the layer. The carpet piece has dimensions slightly larger than the desired carpet tile. Heat is applied to the layer to bond the layer of thermoplastic material to the carpet piece and the bonded layer and carpet piece are cooled so as to form a coated carpet piece. The carrier sheet is then stripped from the coated carpet piece and waste is trimmed from the periphery of the bonded carpet piece so as to form a carpet tile. The carrier sheet is supported on a substantially flat surface during the heating and cooling steps so that the carpet piece is maintained in a substantially flat and relaxed condition and the warps and wefts of the carpet piece do not support the weight of the carpet piece.

3 Claims, 2 Drawing Figures

METHOD OF FORMING CARPET TILES

BACKGROUND OF THE INVENTION

1. Field of the Invention

This invention relates to a method of forming carpet tiles from carpeting coated with a thermo-plastics material.

2. Description of the Prior Art

It is known to provide carpeting with a plastics material coating. However, such known carpeting is generally produced by doctoring a relatively thin layer of plastics material on to the carpeting and curing or gelling the layer by passing the coated carpeting over heated rollers or under infra-red lamps. A relatively thick coating is obtained by repeating the process until the desired dimensions are produced. However, such a known method cannot be used for coating carpeting formed on a heat sensitive backing, for example, polypropylene or paper back carpeting, because the heat required to cure the plastics material coating adversely effects or destroys the backing. Moreover, when carpeting formed on a natural fibre backing, for example hessian, is given a coating of plastics material in the aforesaid manner stresses are set up in the carpeting during cooling with the result that the finished carpeting will not lie flat without being tacked or stuck to the floor on which it is laid. This disadvantage is particularly apparent when the coated carpeting is cut into carpet tiles.

It is an object of the present invention to provide a method of forming carpet tiles wherein the aforementioned disadvantages are obviated or mitigated. SUMMARY OF THE IVENTION We have discovered that in order to manufacture carpet tiles which lie flat when in use the carpeting should first be trimmed to a size which is only slightly larger than the desired carpet tile and thereafter bonded to a layer of thermo-plastics material in such a manner that the warps and wefts of the carpet piece do not support the weight of the carpet piece.

In one example of the method according to the invention a piece of carpeting which may be about 30 inches × 30 inches and comprising tufts needled on to a backing of polyester is given a poly-vinyl-chloride coating as follows:

A carrier sheet of woven glass fibre, coated with a silicone resin to improve the dimensional stability and release properties of the sheet, is laid on a flat surface and a coating of liquid or paste poly-vinyl-chloride is spread over the sheet using a doctor blade. The coating may be up to one-thirtysecond of an inch to one inch thick and the poly-vinyl-chloride may have any suitable composition.

One suitable composition of the poly-vinyl-chloride is:-

| Parts by Weight | Constituents |
|---|---|
| 100 | Emulsion polymerised Poly-vinyl-chloride |
| 80 | Di-Octyl-Phthalate |
| 5 | Di-Butyl-Phthalate |
| 2 | Cadmium Barium Stabiliser |
| 1 | Xylol |
| 5 | Double Boiled Linseed Oil |
| 70 | Stearate Coated Calcium Carbonate |
| 4 | Titanium Rutile |
| 0.125 | Carbon Black (Channel) |

With the coating of poly-vinyl-chloride on the carrier sheet the piece of carpeting is laid on to the poly-vinyl-chloride so as to sandwich the latter between the carpeting and the carrier sheet. The carpeting, coating and carrier sheet are then passed on to a hotplate with the carrier sheet intermediate the plate and the coating. The hotplate is maintained at a temperature between 130° C and 185° C at which temperature the poly-vinyl-chloride of the above composition is cured or gelled in the region of four minutes depending on the thickness of the coating.

When the coating has cured the carpeting, coating and carrier sheet are removed from the hotplate and when the coating has cooled sufficiently the carrier sheet is stripped from the coating and cut into carpet tiles. To obtain tiles which lie flat on a floor on which they are laid the carpeting is heated and subsequently cooled in such a manner that the warps and wefts of the carpet piece do not support the weight of the carpet piece. This is achieved in accordance with the present invention by supporting the carrier sheet on a substantially flat surface during said heating and cooling steps. The surface may be flat or slightly convex.

BRIEF DESCRIPTION OF THE DRAWINGS

In the accompanying drawings.

DESCRIPTION OF THE PREFERRED EMBODIMENT

Figure 1:
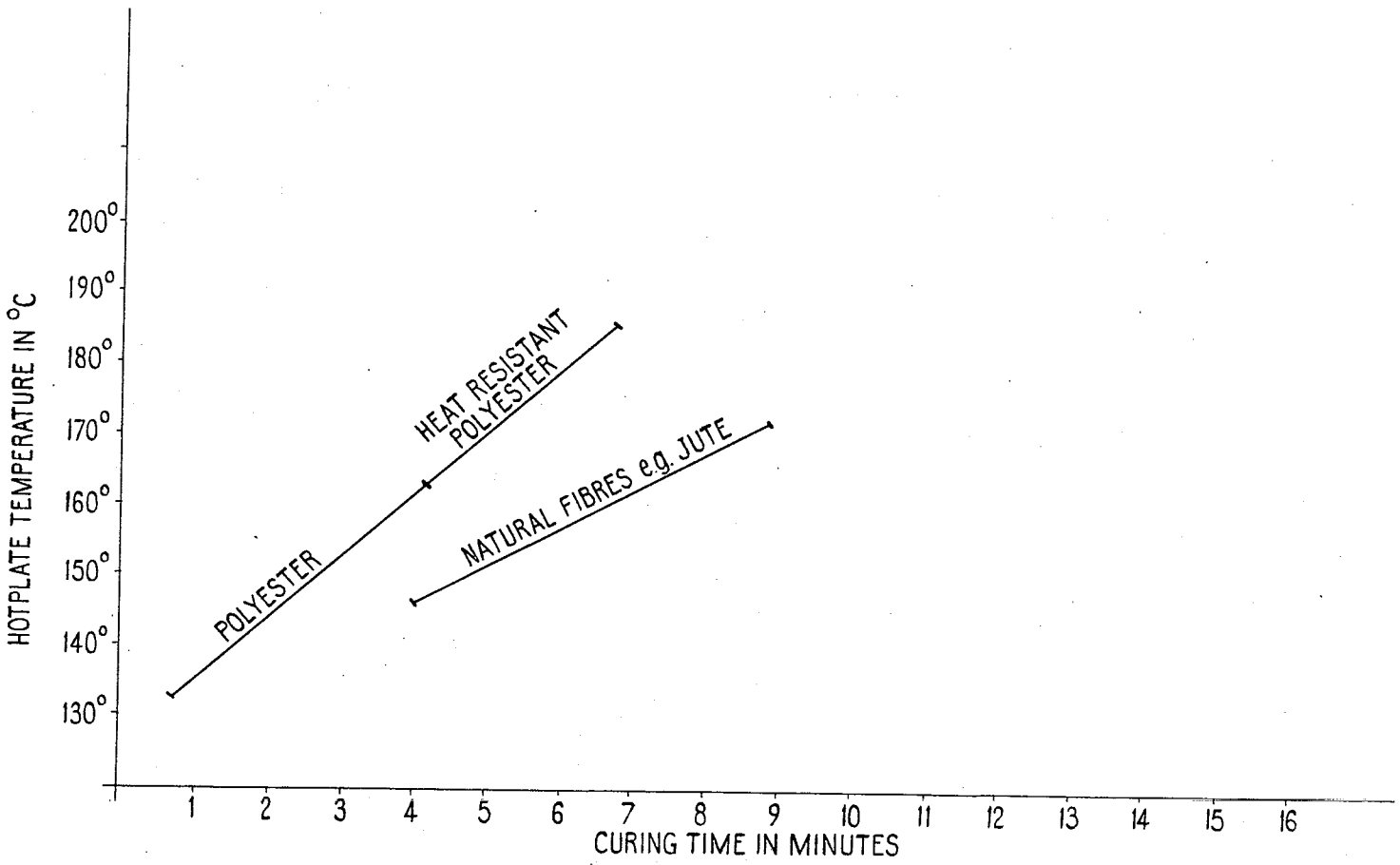
FIG. 1 is a graph of curing time against hot plate temperature for the coating of various materials with the polyvinyl chloride paste described hereinafter.
Figure 2:
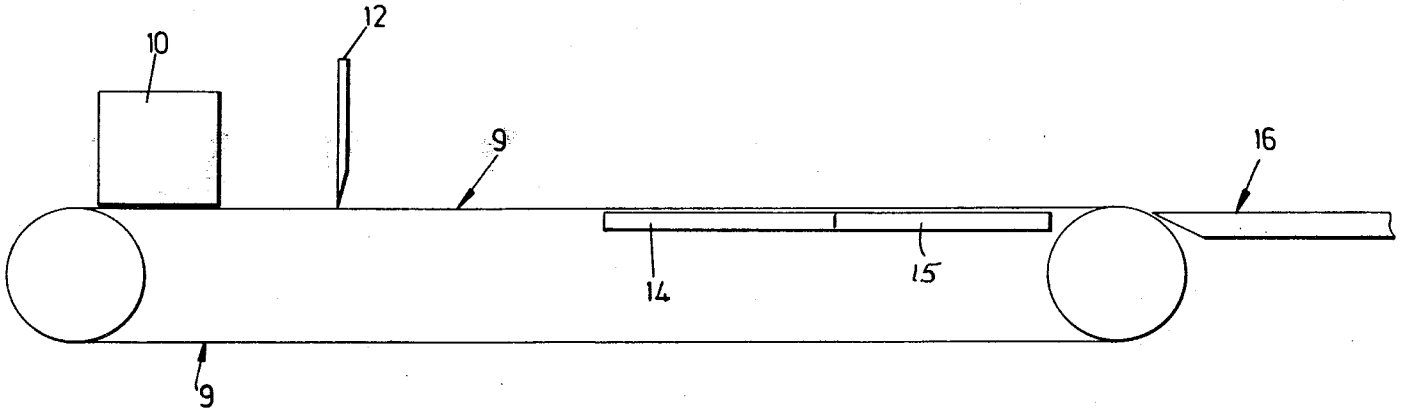
FIG. 2 is a schematic side elevational view of apparatus for practicing the method according to the present invention.

The method according to the invention may be carried out as a continuous process, in which case the carrier sheet is in the form of a continuous belt 9 which passes successively under a dispenser 10 which deposits the thermoplastics material on to the sheet, under a doctor blade 12, over a hotplate 14 and a support 15 for cooling under a stripper blade and 16 which strips the carrier sheet from the coating.

When a coating is to be applied to carpeting needled on to heat resistant polyester the temperature of the hotplate may be raised to around 185° C and the curing or gellation time increased to around 6 minutes depending on the thickness of the coating.

The invention is equally applicable to carpeting formed on any type of backing, for example, hessian, or paper. In the case of hessian-backed carpeting, the hotplate temperature is maintained between 140° C and 170° C and the curing or gellation time may be in the region of 5 minutes.

When the coated carpeting is cut into tiles it is preferred that the cutting blades are applied to the back of the carpeting and must only cut the carpet backing and not cut the pile so that each tile has a fringe of pile which will mate with that of an adjacent tile when laid.

What is claimed is:

1. A method of forming carpet tiles comprising the steps of doctoring a layer of predetermined thickness of thermo-plastics material onto a carrier sheet, laying a piece of carpeting to be coated on said layer, the carpet piece being dimensionally only slightly larger than the desired carpet tile, applying heat to said layer so as to bond the layer of thermo-plastics material to said carpet piece, cooling the bonded layer and carpet piece so as to form a coated carpet piece, stripping the carrier sheet from the coated carpet piece and trimming waste from the periphery of the bonded carpet piece so as to form a carpet tile, and supporting the carrier sheet on a substantially flat surface during said heating and cooling steps whereby the carpet piece is maintained in a substantially flat and relaxed condition and the warps and wefts of the carpet piece do not support the weight of the carpet piece.

2. The method according to claim 1, wherein said carrier sheet is heat resistant and the heat is applied to said layer through said carrier sheet.

3. The method according to claim 1, wherein said thermo-plastics material is in the form of a paste and sufficient heat is applied thereto to cause gellation thereof.

* * * * *